United States Patent [19]

Denis

[11] 4,317,483

[45] Mar. 2, 1982

[54] HEAT EXCHANGER

[75] Inventor: Jean-Pierre Denis, Waterloo, Belgium

[73] Assignee: Jean-Hughes Denis, Monaco, Monaco

[21] Appl. No.: 941,867

[22] Filed: Sep. 13, 1978

[30] Foreign Application Priority Data

Sep. 13, 1977 [LU] Luxembourg ..... 78118

[51] Int. Cl.[3] ..... F16L 41/00; F28F 1/00

[52] U.S. Cl. ..... 165/81; 165/173

[58] Field of Search ..... 165/81, 162, 173, 178; 285/192, 194, 213, 215–217

[56] References Cited

U.S. PATENT DOCUMENTS

| | | | |
|---|---|---|---|
| 937,547 | 10/1909 | Quint | 285/192 |
| 1,981,247 | 11/1934 | Pope | 285/192 X |
| 2,267,314 | 12/1941 | Stikeleather | 165/178 X |
| 3,324,941 | 6/1967 | Divers | 165/178 X |
| 3,447,603 | 6/1969 | Jones | 165/178 |
| 3,559,730 | 2/1971 | Denjean | 165/178 |
| 4,159,035 | 6/1979 | Chartet | 165/173 |

FOREIGN PATENT DOCUMENTS

| | | | |
|---|---|---|---|
| 863195 | 3/1961 | United Kingdom . | |
| 927573 | 5/1963 | United Kingdom | 165/81 |
| 929701 | 6/1963 | United Kingdom | 165/81 |
| 979366 | 1/1965 | United Kingdom . | |
| 1174506 | 12/1969 | United Kingdom | 165/178 |
| 1412672 | 11/1975 | United Kingdom . | |

*Primary Examiner*—Stephen Marcus

*Attorney, Agent, or Firm*—Biebel, French & Nauman

[57] ABSTRACT

There is described a heat exchanger with tubes mounted in tubular bearing plates, each plate being provided with passage openings for said tubes, the cross-section area of said openings being larger than the outer cross-section of the tubes proper and a seal being provided between each tube and the tubular bearing plate, which comprises on either side of the medial plane of each plate, lips which bear resiliently and substantially tightly against the outer wall of the tube passing through the opening while retaining said tube some distance away from the edges bounding the opening.

7 Claims, 6 Drawing Figures

HEAT EXCHANGER

This invention relates to a heat exchanger which comprises tubes mounted in tubular bearing plates, each plate being provided with passage openings for said tubes, the cross-section area of said openings being larger than the outer cross-section of the tubes proper and a seal being provided between each tube and the tubular bearing plate.

A problem which is frequently found in heat exchangers of this kind is to obtain a tight and durable seal between each tube and the tubular plate it is mounted in.

Another important problem in the heat exchangers in general originates in the mechanical stresses caused by the expansion of assembled parts with different expansion factors.

Moreover it is often desirable to obtain a seal which damps the impacts or mechanical vibrations to which the frame of an exchanger can be subjected before such impacts or vibrations reach the tubes.

Finally the seal should allow easy replacing of the tubes and it should be tight whatever seal side has the higher pressure.

Such problems are solved according to the invention because the seal comprises on either side of the medial plane of each plate, lips which bear resiliently and substantially tightly against the outer wall of the tube passing through the opening while retaining said tube some distance away from the edges bounding the opening.

The invention relates more particularly to a heat exchanger in which two fluids between which occurs the exchange, are of a corrosive nature.

In an advantageous embodiment of the invention, each side of the tubular bearing plates is protected by a cover sheet comprised of a corrosion-resistant material, said sheet having a hole facing each opening in the plates used for the passage of a tube and those cover sheet edges which bound said holes are pressed resiliently against the tube outer wall to form said lips.

In a particularly advantageous embodiment of the invention, the heat exchanger comprises a sleeve which is arranged inside said opening about the tube some distance away therefrom, the seal being formed by two rings secured to the sleeve ends and bearing on the tubular plate, each such rings having at least one lip facing the tube which is pressed resiliently and tightly against the tube outer wall while retaining same some distance away from the sleeve inner wall.

Other details and features of the invention will stand out from the following description given by way of non limitative example and with reference to the accompanying drawings, in which.

In the various figures the same reference numerals pertain to similar elements.

This invention relates to heat exchangers which are essentially comprised of a series of spaced tubes substantially in parallel relationship together, the ends of said tubes being mounted inside openings provided in tubular bearing plates. Even if the invention can be applied to heat exchangers for any kind of fluids, it does mainly pertain to heat exchangers for corrosive gases.

Figure 1:
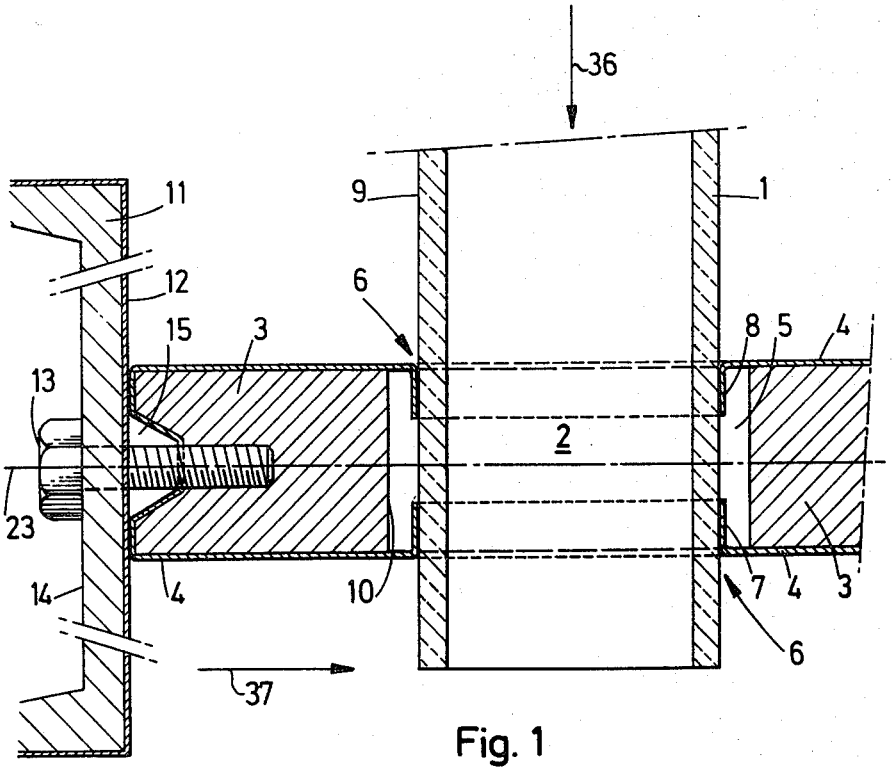
FIG. 1 is a cross-section view with parts broken away of a portion from a tube which is mounted in a tubular bearing plate by means of a resilient seal, in a heat exchanger according to a first embodiment of the invention.

FIG. 1 shows a tube 1 mounted inside an opening 2 in a tubular bearing plate 3 from a heat exchanger. A fluid flows for instance along the direction shown by arrow 36 inside the tube, while a second fluid flows outside the tube, for instance along the direction as shown by arrow 37. To protect the tubular plate 3 from the corrosion caused by the fluids flowing through the heat exchanger, said plate is coated with a protective layer made from a corrosion-resistant material. Said layer is usefully comprised of a sheet 4 from said material, which is stretched over the tubular plate and is provided with holes facing the openings provided in the plate to let the tubes pass through. Said sheet 4 may advantageously in particular be made of polytetrafluorethylene which is notably known under the registered trade-mark "Teflon", which is a material having remarkable characteristics of resistance to the corrosion, of resiliency and generally of permanency. Tubes having an excellent resistance to corrosion can be made from borosilicate glass, which material is however sensitive to impacts and mechanical vibrations which can be transmitted thereto through a conventional seal.

As may be noted from the drawings, the cross-section area of the opening 2 is larger than the outer cross-section of tube 1. This means that there is according to the invention, a space or gap 5 between tube 1 and tubular plate 3. The tube 1 is retained by means of a seal or joint 6 which comprises, on either side of the medial plane 23 of tubular plate 3, lips 7 and 8 which clamp resiliently and substantially tightly the outer wall 9 of the tube passing through the opening 2 while retaining same some distance away from those edges 10 which define the opening.

As said lips 7 and 8 are of a resilient nature and retain the tube 1 some distance away from the tubular plate, the relative size changes caused by the various materials used under the action of temperature differentials, do not induce any inner stress at the interfaces between said materials.

Moreover this resilient assembly of the tubes on the tubular bearing plate gives a better resistance to impacts and mechanical vibrations.

On the other hand said seal allows to adjust the slope of the tubes without disassembly thereof; this may be useful when condensates should be discharged from said tubes. It is also very easy to replace a tube or even the whole tube set without having to disassemble complex fastening members which get damaged in the process.

The tubular bearing plate is in turn fastened to a bearing frame 11 which has been partly shown in FIG. 1.

Said frame, when the heat exchanger is designed for corrosive fluids, is also covered with a protective sheet 12 which is for example made from polytetrafluororethylene and stretched over the frame sides. To secure the tubular plate 3 to frame 11, fasteners 13 such as screws have been provided, said fasteners bearing on the one hand on the outer wall 14 not subjected to corrosion and on the other hand, being connected to the tubular bearing plate. More particularly when the fasteners are formed by screws 13 as shown in FIG. 1, said screws go through the bearing frame 11 and enter the tubular bearing plate 3 to press same against the frame in such a way that the sheets 12 and 4 are clamped against one another to form a tight seal protecting the fasteners from the corrosion. In the embodiment as shown in FIG. 1, a lengthwise groove 15 has been provided in the side edge of tubular plate 3, at the bottom of which is formed a threaded bore in which fastener 13 is screwed.

The tube 1 is made for instance from borosilicate glass.

Figure 2:
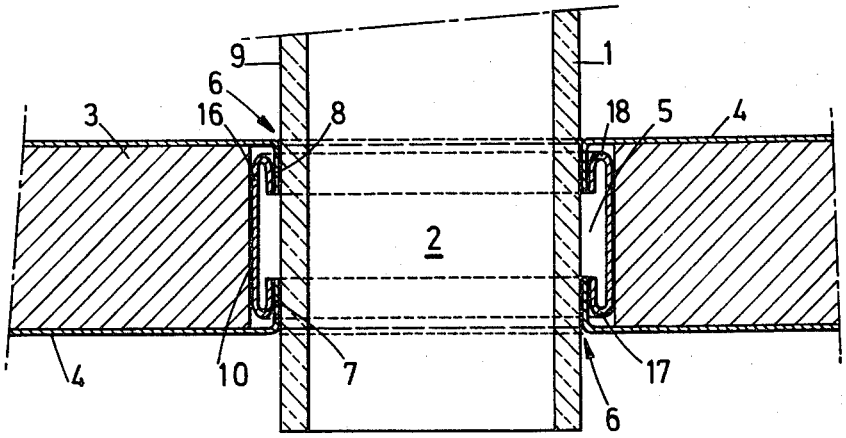
FIGS. 2 to 5 are cross-section views similar to FIG. 1 but showing other embodiments of the invention.

FIG. 2 shows another embodiment of the invention in which the seal between tube and tubular plate 3 is formed by lips 7 and 8 which are comprised of the edges of the cover sheet 4. A sleeve 16 is arranged in the passage opening 2 for tube 1 while leaving a free space 5 between said tube and wall 10 of the opening 2. Said sleeve is provided to protect said wall 10 from the corrosion in the case where corrosive fluids would seep into gap 5 and the sleeve is preferably made from polytetrafluorethylene. Moreover said sleeve 16 has according to the invention, lips 17 and 18 facing the tube 1 and bearing on the inner surface of those lips 7 and 8 formed by cover sheet 4. Said lips 17 and 18 are resilient and press the sleeve against the wall 10 of opening 2 while pushing more strongly the lips 7 and 8 towards outer wall 9 of tube 1. In such a way the tightness and strength of the seal 6 formed by said lips 7 and 8 is increased. Advantageously said lips 17 and 18 are comprised of the ends of sleeve 16 looped back on the same side.

Figure 3:
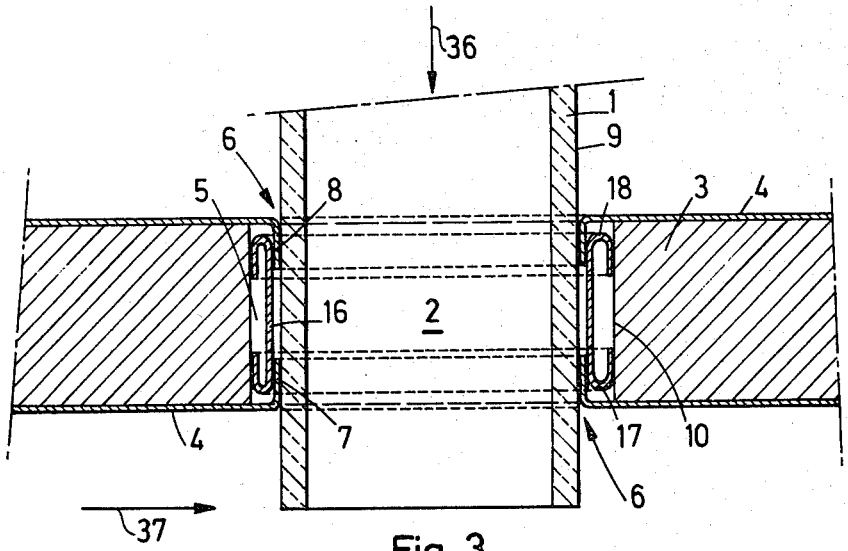

FIG. 3 pertains to a variation in the embodiment shown in FIG. 2. In the present case the sleeve 16 is provided with lips 17 and 18 facing the wall 10 of opening 2 and bearing thereon to press the sleeve against the inner surfaces of the lips 7 and 8 formed by the cover sheet. The resiliency of the lips 17 and 18 will also be added to the one of the lips 7 and 8 respectively, so as to improve the tightness and the strength of seal 6 and the wall 10 of opening 2 is also protected. As in the embodiment described previously, the lips 17 and 18 are advantageously comprised of the looped back edges of sleeve 16.

Figure 4:
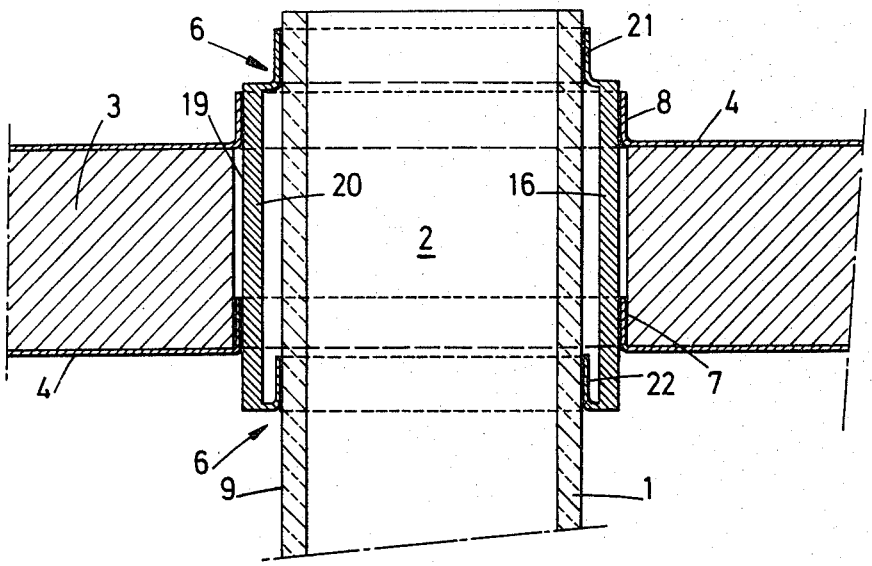

FIG. 4 shows still another embodiment of the resilient seal 6 between tube 1 and tubular plate 3. There has been provided in this case a sleeve 16 from polytetrafluorethylene which is arranged in the opening 2 about tube 1 some distance away therefrom. This sleeve 16 extends on either side beyond the tubular bearing plate 3 covered by sheet 4, in such a way that the lips 7 and 8 formed by the edges of said sheet 4 bear resiliently against the outer wall 19 of said sleeve and form a tight resilient seal between said sleeve and the tubular plate 3. The inner wall 20 of sleeve 16 lying some distance away from the outer wall 9 of tube 1 is provided with lips 21 and 22 facing said wall 9, which bear resiliently and tightly on tube 1 to retain same resiliently some distance away from the edge 10 of opening 2. In this embodiment of the invention, the tube 1 is thus retained in position through the sleeve 16. Consequently it is required that this sleeve be clamped in the tubular bearing plate 3. For this purpose the sleeve 16 is so manufactured as to have a cross-section equal to or somewhat smaller than the cross-section of opening 2 at the mounting temperature of tube 1 into plate 3. During the operation of the heat exchanger at a higher temperature, the sleeve 16 expands more than tubular plate 3 due to the higher expansion factor of polytetrafluorethylene relative to the expansion factor of the steel said plate is usually made of. In this way, the sleeve 16 is strongly pressed against the wall 10 of opening 2 during operation.

Figure 5:
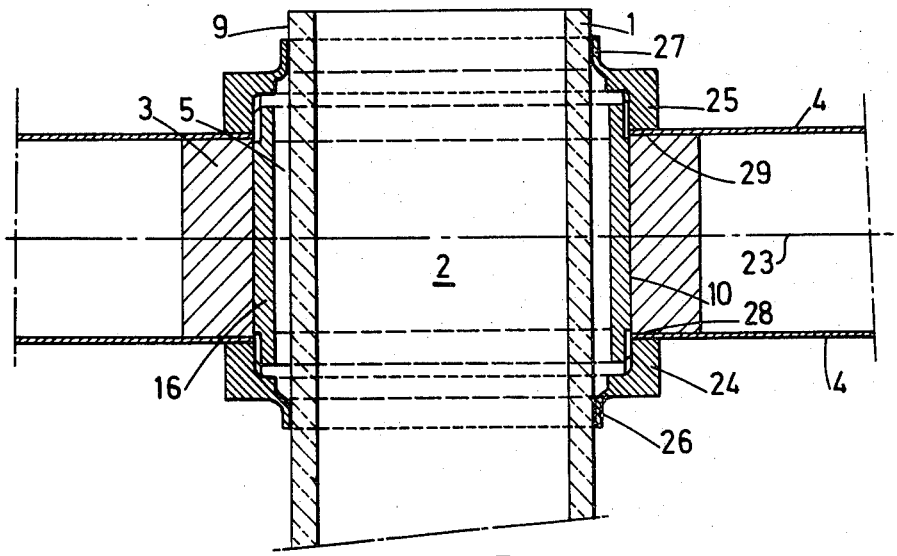

FIG. 5 shows another embodiment of the seal 6 which retains resiliently and tightly the tube 1 some distance away from the edge 10 of opening 2 for the passage of said tube 1 through tubular plate 3. The seal shown in FIG. 5 can also be used to retain according to the invention the tube on a tubular bearing plate which is not covered with a sheet 4, that is which is not protected. According to the invention, a sleeve 16 with an inner diameter larger than the tube outer diameter, is arranged inside the opening about tube 1, to leave a free space between tube 1 and sleeve 16. The ends of said sleeve 16 project from the surfaces of the tubular bearing plate 3. Two rings 24 and 25 are slipped over tube 1 on either side of the medial plane 23 of the tubular bearing plate 3 and they are made fast to the ends of sleeve 16. Said rings 24 and 24 may particularly be screwed on said ends of sleeve 16. Said rings have on the edges thereof facing tube 1, lips 26 and 27 which press against the outer wall 9 thereof to form seal 6. When fastening said rings 24 and 25 to the ends of sleeve 16, care is taken to have the surfaces 28 and 29 thereof facing plate 3 bear firmly on said plate 3 to fix sleeve 16 about tube 1 some distance away therefrom. A fastening by screwing is then particularly advantageous as it allows to press the rings firmly against plate 3 without any difficulty. In the case where plate 3 is covered by a protective sheet 4, said sheet is clamped over the edges surrounding the opening 2, between the rings 24 and 25 and plate 3, to form a tight seal. When a protection against corrosion is desired, the sleeve 16 and the rings 24 and 25 with the resilient lips 26 and 27 thereof are made from a material which is resistant to corrosion, for example polytetrafluorethylene. With such an embodiment, there is obtained a resilient seal 6 which is particularly simple and protects efficiently the tubular plate 3 against the corrosion.

Figure 6:
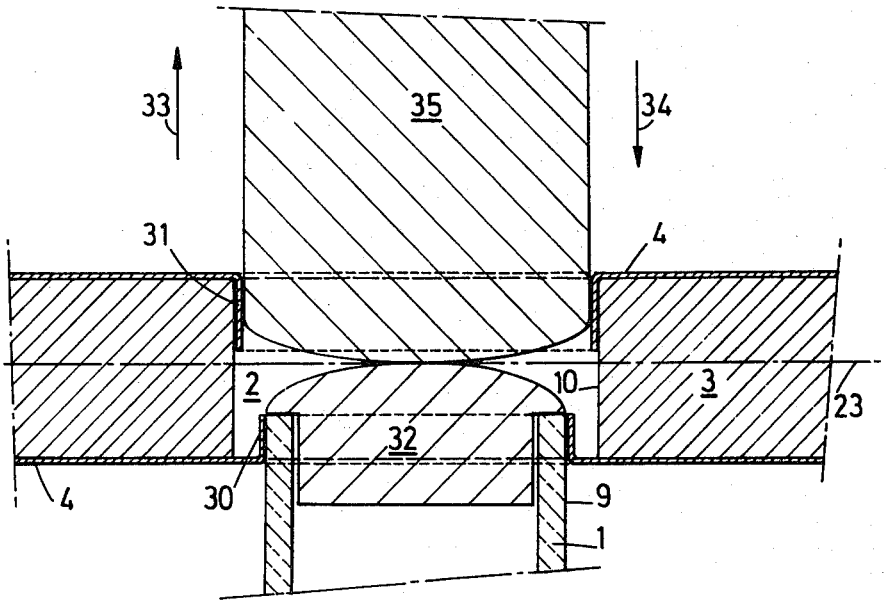
FIG. 6 is a cross-section view showing a method for mounting a tube into a tubular bearing plate.

FIG. 6 shows a method for mounting tube 1 into the opening 2 of tubular plate 3 which allows to obtain a seal 6 according to the embodiment as shown in FIG. 1. In FIG. 6 the tubular plate is covered with a sheet 4 the edges 30 and 31 of which about the passage opening 2, are to form the lips of the seal with tube 1. The end of said tube 1 is topped by a guide cone 32 the base of which has substantially the same cross-section as the tube and is fitted in the opening 2 on the one side of the medial plane 23 of tubular plate 3 along the direction of arrow 33 to enter partly the opening 2. On the other side of medial plane 23, a guide cone 35 the cross-section of which is substantially equal to the one of opening 2, is slipped in the opening 2 along the direction of arrow 34, down to the abutment with part 32. In this position shown in FIG. 6, the edge 30 is bent inwards in the opening 2 and bears on tube 1 or part 32, while the edge 31 is bent inwards in the opening 2 by part 35, more markedly than for edge 30. The part 35 and tube 1 provided with part 32 are then moved together along the direction of arrow 33, by maintaining the parts 32 and 35 engaged until the end of the tube, bearing part 32, has passed edge 31 of the cover sheet. When part 35 releases said edge 31, edge 31 bears resiliently on the outer wall 9 of tube 1 or on part 32 while remaining bent inwards in opening 2. The mounting of tube 1 is then completed by moving same along the direction of arrow 33 to the required position.

It must be understood that the invention is in no way limited to the above embodiments and that many changes can be brought therein without departing from the scope of the invention as defined by the appended claims.

For instance the tubes do not have necessarily to be of cylinder shape.

I claim:

1. Heat exchanger with tubes mounted in tubular bearing plates, each plate being provided with passage openings for said tubes, the cross-section area of said openings being larger than the outer cross-section of the tubes proper and a sleeve being provided between each tube and the tubular bearing plates, which includes at least one lip which bears resiliently and substantially tightly against the outer wall of the tube passing through the openings while retaining said tube some distance away from the edges bounding the openings, said sleeve being made of at least two different separable pieces, a first one being arranged at least partly inside said opening about the tube, a part of this first piece outside the opening being applied around the opening, against an outside surface of one of said bearing plates, a second piece being a ring screwed to an end of said first one, opposite to said part, against an opposite outside surface of one of said tubular bearing plates.

2. Heat exchanger according to claim 1 in which the first piece comprises a sleeve body arranged inside said opening about the tube some distance away therefrom, the part of this piece outside the opening being formed by a ring screwed to one end of this sleeve body, the other ring being screwed to the opposite end of the sleeve body, both rings bearing against the outside surfaces of the tubular bearing plates.

3. Heat exchanger as defined in claim 2, in which when the tubular plate is protected over at least one surface thereof by a cover sheet and said sheet, the sleeve and the rings are made from a corrosion-resistant material, the cover sheet is clamped between that tubular plate surface it does cover and the ring fastened to the sleeve to insure the tightness.

4. Heat exchanger as defined in claim 2, wherein the sleeve is made from corrosion-resistant material.

5. Heat exchanger as defined in claim 3 or 4 characterized in that the corrosion-resistant material used is poletetrafluorethylene known under the registered trade-mark "Teflon".

6. Heat exchanger as defined in claim 2, in which the exchanger tubes are made from borosilicate glass.

7. Heat exchanger with tubes mounted in tubular bearing plates, each plate being provided with passage openings for said tubes, the cross-section area of said openings being larger than the outer cross-section of the tubes proper and a seal being provided between each tube and the tubular bearing plate, which comprises on either side of the medial plane of each plate, lips which bear resiliently and substantially tightly against the outer wall of the tube passing through the opening while retaining said tube some distance away from the edges bounding the opening; and a sleeve arranged inside said opening about the tube some distance away therefrom, the seal being formed by two rings fastened to the sleeve ends and bearing on the tubular plate, each such ring having at least one lip facing the tube which is pressed resiliently and tightly against the tube outer wall while retaining same some distance away from the sleeve inner wall and the rings are screwed on the sleeve ends so as to bear against the surfaces of the tubular bearing plate.

* * * * *